US005924173A

United States Patent [19]

Dobreski et al.

[11] Patent Number: 5,924,173

[45] Date of Patent: Jul. 20, 1999

[54] END POSTS FOR PLASTIC ZIPPER

[75] Inventors: David V. Dobreski, Fairport; Michael W. McManus, East Rochester, both of N.Y.

[73] Assignee: Tenneco Packaging, Evantson, Ill.

[21] Appl. No.: 08/698,923

[22] Filed: Aug. 16, 1996

[51] Int. Cl.[6] ..... A44B 19/00; B65D 33/00

[52] U.S. Cl. ..... 24/400; 24/387; 24/587

[58] Field of Search ..... 24/400, 399, 389, 24/435, 587, 387; 383/63, 64, 65

[56] References Cited

U.S. PATENT DOCUMENTS

| | | | |
|---|---|---|---|
| 4,312,102 | 1/1982 | Fukuroi | 24/389 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,088,971 | 2/1992 | Herrington | 493/203 |
| 5,131,121 | 7/1992 | Herrington, Jr. et al. | 24/436 |
| 5,152,613 | 10/1992 | Herrington, Jr. | 383/63 |
| 5,161,286 | 11/1992 | Herrington, Jr. et al. | 24/387 |
| 5,189,764 | 3/1993 | Herrington et al. | 24/387 |
| 5,283,932 | 2/1994 | Richardson et al. | 24/400 |
| 5,301,394 | 4/1994 | Richardson et al. | 24/399 |
| 5,301,395 | 4/1994 | Richardson et al. | 24/400 |
| 5,405,478 | 4/1995 | Richardson et al. | 156/308.4 |
| 5,426,830 | 6/1995 | Richardson et al. | 24/430 |
| 5,431,760 | 7/1995 | Donovan | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,448,808 | 9/1995 | Gross | 24/400 |
| 5,482,375 | 1/1996 | Richardson et al. | 383/64 |
| 5,669,715 | 9/1997 | Dobreski et al. | 383/5 |
| 5,682,730 | 11/1997 | Dobreski | 53/469 |

FOREIGN PATENT DOCUMENTS

| | | | |
|---|---|---|---|
| 1448529 | 8/1966 | France | 24/389 |
| WO95/29604 | 11/1995 | WIPO . | |
| WO95/35046 | 12/1995 | WIPO . | |
| WO95/35047 | 12/1995 | WIPO . | |
| WO95/35048 | 12/1995 | WIPO . | |

*Primary Examiner*—Victor N. Sakran
*Attorney, Agent, or Firm*—Arnold, White & Durkee

[57] ABSTRACT

A plastic bag comprises first and second opposing panels, a reclosable zipper, and a slider. The first and second opposing panels are fixedly connected to each other along a pair of sides and a bottom bridging the pair of sides. The reclosable zipper extends along a mouth formed opposite the bottom. The zipper includes a first track with a first profile and a second track with a second profile. The first and second profiles are releasably engageable to each other. The slider is slidably mounted to the zipper for movement between a closed position and an open position. The first and second profiles are engaged to each other while the slider is in the closed position, and the first and second profiles are disengaged from each other in response to movement of the slider from the closed position to the open position. To prevent the slider from going past the ends of the zipper and to provide adequate end strength that resists stresses applied to the profiles during normal use of the bag, end terminations in the form of posts pass through the male and female tracks adjacent to the ends of the zipper. To retain the posts on the zipper, each of the posts includes enlarged heads at its opposing ends.

18 Claims, 2 Drawing Sheets

END POSTS FOR PLASTIC ZIPPER

FIELD OF THE INVENTION

The present invention generally relates to reclosable plastic bags and, more particularly, to a reclosable plastic bag including a zipper having an obstruction in the form of a post extending through tracks of the zipper.

BACKGROUND OF THE INVENTION

A reclosable plastic bag typically includes first and second opposing panels fixedly connected to each other along a pair of sides and a bottom bridging the pair of sides. The first and second panels are not fixedly connected along a mouth which is formed opposite to the sealed bottom. Rather, the bag is provided with a reclosable zipper extending along the mouth of the plastic bag. The zipper includes a male track and a female track. In reclosable plastic bags of the type disclosed in U.S. Pat. No. 5,067,208 utilizing a slider to open the zipper, the male track typically includes a male profile and a first fin extending downward from the male profile. Likewise, the female track in such bags with sliders includes a female profile and a second fin extending downward from the female profile. The first and second fins are thermally fused to the inner surfaces of the respective first and second panels.

The male and female tracks are typically free of any plastic material above the male and female profiles in order to permit proper mounting and movement of the slider. The male and female profiles are releasably engageable to each other. When the slider is in a closed position, the male and female profiles are interlocked with each other. In response to moving the slider to an open position, the male and female profiles are disengaged from each other. Once the male and female profiles are disengaged from each other, access to the interior of the bag may be obtained by pulling the first and second panels apart at the mouth.

Opposite ends of the zipper are provided with end terminations. The end terminations perform the dual function of stops for the ends of the zipper to prevent the slider from going past the ends of the zipper and, in addition, they hold the male and female profiles together to resist stresses applied to the profiles during normal use of the plastic bag. In U.S. Pat. No. 5,067,208, each end termination is in the form of a strap/clip that wraps over the top of the zipper. One end of the strap is provided with a rivet-like member that penetrates through the zipper fins and into a cooperating opening at the other end of the strap. Other types of end terminations are disclosed in U.S. Pat. Nos. 5,482,375, 5,448,807, 5,442,837, 5,405,478, 5,161,286, 5,131,121, and 5,088,971.

SUMMARY OF THE INVENTION

The present invention provides end terminations for a zipper of a reclosable plastic bag. The plastic bag comprises first and second opposing panels fixedly connected to each other along a pair of sides and a bottom bridging the pair of sides. The bag is provided with a reclosable zipper extending along a mouth formed opposite the sealed bottom of the plastic bag. The zipper includes a male track and a female track. The male track includes a male profile and a first depending fin extending downward from the male profile. Likewise, the female track includes a female profile and a second depending fin extending downward from the female profile. If the zipper is formed separately from the panels of the bag, the first and second depending fins are thermally fused to inner surfaces of the respective first and second panels. Alternatively, the zipper may be integrally formed with the panels of the bag.

A slider is slidably mounted to the zipper for movement between a closed position and an open position. The male and female profiles are engaged to each other while the slider is in the closed position. The male and female profiles are disengaged from each other in response to movement of the slider to the open position.

To prevent the slider from going past the ends of the zipper and to provide adequate end strength that resists stresses applied to the profiles during normal use of the bag, end terminations in the form of posts pass through the male and female tracks adjacent to the ends of the zipper. The posts may be inserted through either the profiles or fins of the zipper. To retain the posts on the zipper, each of the posts includes enlarged heads at its opposing ends. These enlarged heads may be formed by pressure, heat, or ultrasonic melting.

BRIEF DESCRIPTION OF THE DRAWINGS

Other objects and advantages of the invention will become apparent upon reading the following detailed description and upon reference to the drawings in which.

Figure 1:
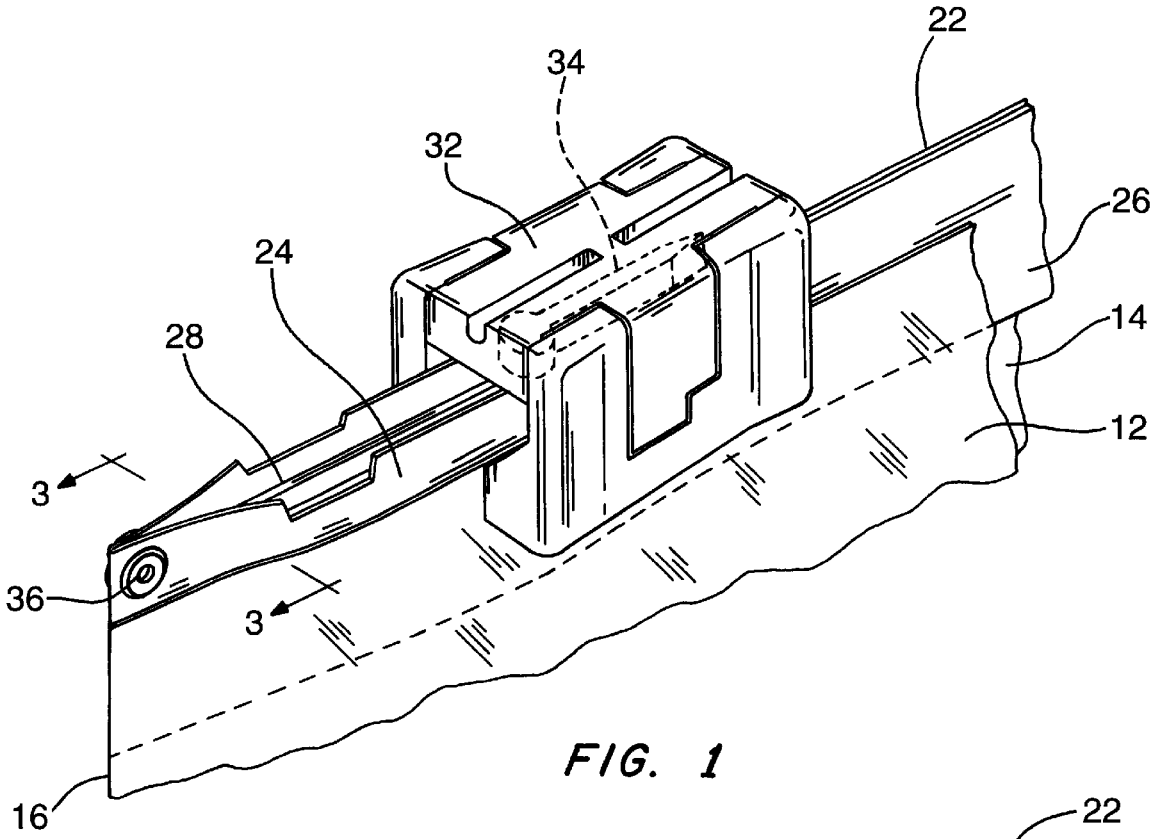
FIG. 1 is an isometric view of a mouth portion of a reclosable plastic bag having an end post inserted through the profiles of a zipper.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Figure 2:
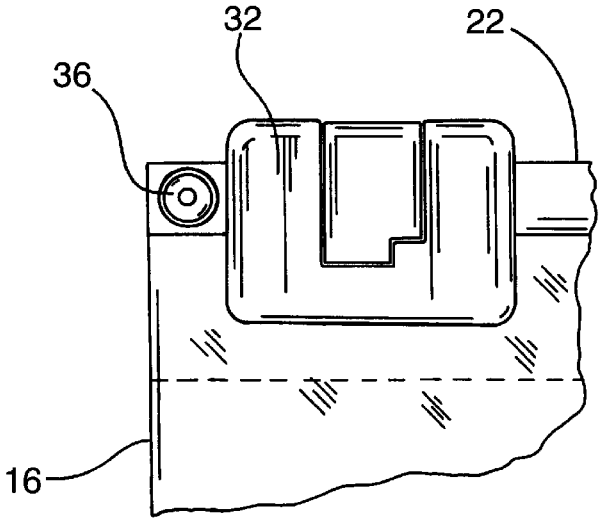
FIG. 2 is a front view of the bag mouth portion in FIG. 1.
Figure 3:
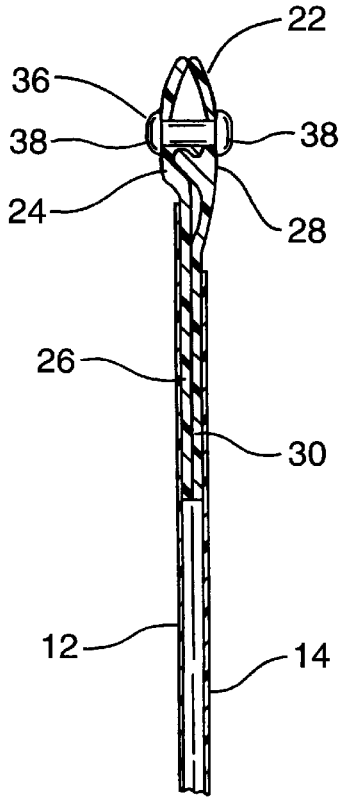
FIG. 3 is a sectional view taken generally along line 3—3 in FIG. 1.

Turning now to the drawings, FIGS. 1–3 depict a mouth portion of a reclosable plastic bag embodying the present invention. The plastic bag comprises first and second opposing panels 12 and 14 fixedly connected to each other along a pair of sides 16 (only one shown in FIGS. 1 and 2) and a bottom bridging the pair of sides 16. The bag is provided with a reclosable zipper 22 extending along the mouth portion, which is formed opposite the sealed bottom of the plastic bag.

The zipper 22 includes a male track and a female track. The male track includes a male profile 24 and a first depending fin or flange 26 extending downward from the male profile 24. Likewise, the female track includes a female profile 28 and a second depending fin or flange 30 extending downward from the female profile 28. If the zipper 22 is formed separately from the panels 12 and 14 of the bag, the first and second fins 26 and 30 are thermally fused to inner surfaces of the respective first and second panels 12 and 14. Alternatively, the zipper 22 may be integrally formed with the panels 12 and 14 such that the first fin 26 is integrally formed with the first panel 12 and the second fin 30 is integrally formed with the second panel 14.

To assist in opening the plastic bag, a slider 32 is slidably mounted to the zipper 22 for movement between a closed position and an open position. In the closed position of the slider 32 shown in FIG. 2, the male and female profiles 24 and 28 are interlocked with each other. Movement of the slider 32 from the closed position in FIG. 2 toward the open position (see FIG. 1) disengages the male and female profiles 24 and 28 from each other and allows a user to gain access to the interior of the plastic bag. The slider 32 includes a separator finger 34 (FIG. 1) for disengaging the male and female profiles 24 and 28 from each other. Further details concerning the construction and operation of the zipper 22 and slider 32 may be obtained from U.S. Pat. No. 5,067,208 to Herrington, Jr. et al., which is incorporated herein in its entirety by reference.

Figure 4:
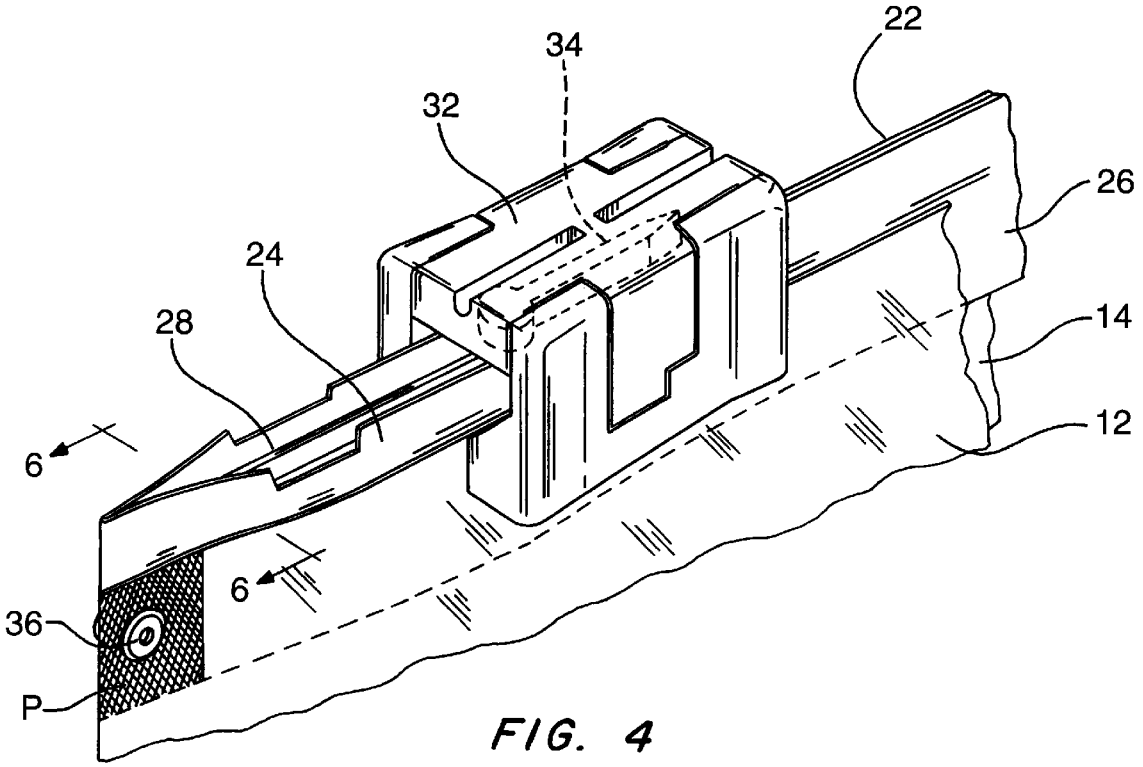
FIG. 4 is an isometric view of a mouth portion of a reclosable plastic bag having an end post inserted through the depending fins of a zipper.
Figure 5:
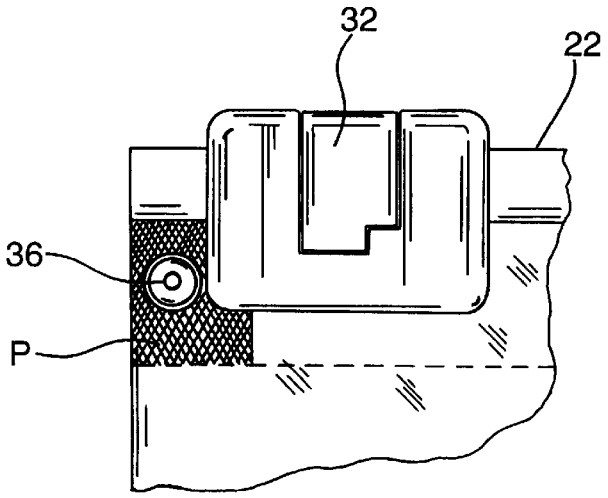
FIG. 5 is a front view of the bag mouth portion in FIG. 4.
Figure 6:
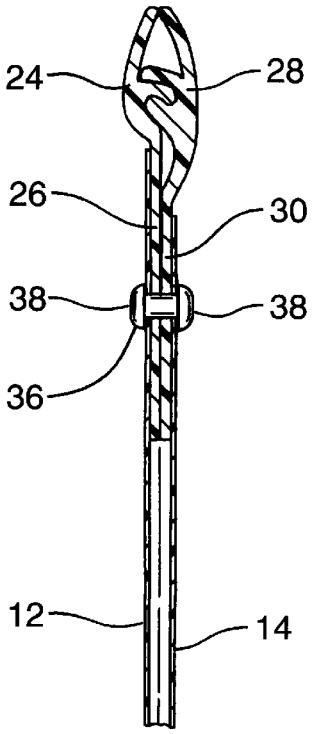
FIG. 6 is a sectional view taken generally along line 6—6 in FIG. 4.

To prevent the slider 32 from going past the ends of the zipper 22 and to provide adequate end strength that resists stresses applied to the profiles 24 and 28 during normal use of the bag, end terminations in the form of plastic pins or posts 36 pass through the male and female tracks adjacent to the ends of the zipper 22. In one embodiment depicted in FIGS. 1–3, the posts 36 extend through the profiles 24 and 28. In another embodiment depicted in FIGS. 4–6, the posts 36 extend through the bag panels 12 and 14 below the profiles 24 and 28 and preferably extend through the fins 26 and 30 at preseal areas P of the zipper 22. Using an ultrasonic welder or heat bar, the preseal areas P are formed on the fins 26 and 30 and facing bag panels 12 and 14 at the ends of the zipper 22 to reduce the material thickness and prepare for a leakproof end termination.

The posts 36 are generally linear in configuration and have a substantially circular cross-section. Other cross-sectional shapes are possible. Prior to inserting the posts 36 through the zipper 22, the posts 36 have a generally uniform cross-section throughout their length except at the ends, which are preferably sharp enough to pierce and penetrate through the zipper 22. Alternatively, the posts 36 may be inserted through preformed holes in the zipper 22. The posts 36 are installed onto the zipper 22 by forcing the pointed posts 36 through the zipper 22 at the desired location. As stated above, the posts 36 are inserted through the profiles 24 and 28 in the embodiment of FIGS. 1–3, while the posts 36 are inserted through the bag panels 12 and 14 and the fins 26 and 30 in the embodiment of FIGS. 4–6.

To retain the posts 36 on the zipper 22 in both embodiments, each of the posts 36 includes a pair of opposing enlarged heads 38 that are formed by pressure, heat, or ultrasonic melting after the posts 36 are inserted through the zipper 22. One of the enlarged heads 38 abuts the outer surface of the first panel 12 (FIG. 6) or male profile 24 (FIG. 3), and the other of the enlarged heads 38 abuts the outer surface of the second panel 14 (FIG. 6) or female profile 28 (FIG. 3). The posts 36 preferably have a length only slightly greater than the thickness of the region through which the posts 36 are inserted so that the heads 38 firmly secure the posts 36 to the zipper 22 and there is minimal or no movement of the posts 36 relative to the zipper 22.

The posts 36 may be molded from any suitable plastic, including but not limited to nylon, polypropylene, polystyrene, high-density polyethylene, Deirin, or ABS.

The posts 36 are advantageous in that, unlike straps that wrap over the top of the zipper, the posts 36 require a minimal amount of plastic material. At the same time, the posts 36 adequately perform the dual function of stops for the ends of the zipper 22 to prevent the slider 32 from going off past the end of the zipper 22 and they hold the profiles 24 and 28 together to resist stresses applied to the profiles through normal use of the bag.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. In a reclosable plastic bag including first and second opposing panels fixedly connected to each other along a pair of sides and a bottom bridging said pair of sides; a reclosable zipper extending along a mouth formed opposite said bottom, said zipper including a first track with a first profile and a second track with a second profile, said first and second profiles being releasably engageable to each other; and a slider slidably mounted to said zipper for movement between a closed position and an open position, said first and second profiles being engaged to each other while said slider is in said closed position, said first and second profiles being disengaged from each other in response to movement of said slider from said closed position to said open position, an end stop arrangement comprising:

posts extending through said first and second tracks near opposing ends of said zipper adjacent to said pair of sides, said posts each including a generally linear member and a pair of enlarged heads at opposite ends of said generally linear member, said pair of enlarged heads being disposed on opposite sides of said zipper for retaining said posts on said zipper, said end stop arrangement being free of plastic material extending over a top of said zipper, said posts holding said first and second tracks together near said opposing ends of said zipper, said posts being arranged to directly contact and stop said slider at said closed and open positions.

2. The end stop arrangement of claim 1, wherein said posts extend through said first and second profiles.

3. The end stop arrangement of claim 1, wherein said posts extend through said first and second panels below said first and second profiles.

4. The end stop arrangement of claim 1, wherein said first track includes a first fin extending downward from said first profile and said second track includes a second fin extending downward form said second profile, and wherein said posts extend through said first and second fins.

5. The end stop arrangement of claim 1, wherein said posts each have a generally circular cross-section.

6. The end stop arrangement of claim 1, wherein said pair of enlarged heads abut said respective opposite sides of said zipper.

7. A reclosable plastic bag, comprising:

first and second opposing panels fixedly connected to each other along a pair of sides and a bottom bridging said pair of sides;

a reclosable zipper extending along a mouth formed opposite said bottom, said zipper including a first track with a first profile and a second track with a second profile, said first and second profiles being releasably engageable to each other;

a slider slidably mounted to said zipper for movement between a closed position and an open position, said first and second profiles being engaged to each other while said slider is in said closed position, said first and second profiles being disengaged from each other in response to movement of said slider from said closed position to said open position; and an end stop arrangement including posts extending through said first and second tracks near opposing ends of said zipper adjacent to said pair of sides, said posts each including a generally linear first member and a first pair of enlarged heads at opposite ends of said generally linear first member, said first pair of enlarged heads being disposed on opposite sides of said zipper for retaining said posts on said zipper, said end stop arrangement being free of plastic material extending over a top of said zipper, said posts holding said first and second tracks together near said opposing ends of said zipper, said posts being arranged to directly contact and stop said slider at said closed and open positions.

8. The plastic bag of claim 7, wherein said posts extend through said first and second profiles.

9. The plastic bag of claim 7, wherein said posts extend through said first and second panels below said first and second profiles.

10. The plastic bag of claim 7, wherein said first track includes a first fin extending downward from said first profile and said second track includes a second fin extending downward form said second profile, and wherein said posts extend through said first and second fins.

11. The plastic bag of claim 10, wherein first and second fins are sealed to each other where said posts extend therethrough.

12. The plastic bag of claim 7, wherein said posts each have a generally circular cross-section.

13. The plastic bag of claim 7, wherein said first pair of enlarged heads abut said respective opposite sides of said zipper.

14. In a reclosable plastic bag including first and second opposing panels fixedly connected to each other along a pair of sides and a bottom bridging said pair of sides; a reclosable zipper extending along a mouth formed opposite said bottom, said zipper including a first track with a first profile and a second track with a second profile, said first and second profiles being releasably engageable to each other; and a slider slidably mounted to said zipper for movement between a closed position and an open position, said first and second profiles being engaged to each other while said slider is in said closed position, said first and second profiles being disengaged from each other in response to movement of said slider from said closed position to said open position, a method of stopping said slider at opposing ends of said zipper adjacent said pair of sides, said method comprising the steps of:

providing an end stop arrangement including posts each having first and second ends;

inserting said posts through said first and second tracks near said opposing ends of said zipper; and after said posts are inserted through said first and second tracks, forming enlarged heads on said respective first and second ends of each post to retain said posts on said zipper, said enlarged heads being disposed on opposite sides of said zipper, said posts holding said first and second tracks together near said opposing ends of said zipper, said posts being arranged to directly contact and stop said slider at said closed and open positions.

15. The method of claim 14, wherein said posts are inserted through said first and second profiles.

16. The method of claim 14, wherein said first track includes a first fin extending downward from said first profile and said second track includes a second fin extending downward form said second profile, and wherein said posts are inserted through said first and second fins.

17. The method of claim 16, further including the step of sealing said first and second fins to each other where said posts are subsequently inserted.

18. The method of claim 14, wherein at least said first end of each post is pointed, and wherein said step of inserting said posts through said first and second tracks includes piercing said first and second tracks with said pointed first end.

* * * * *

UNITED STATES PATENT AND TRADEMARK OFFICE

CERTIFICATE OF CORRECTION

PATENT NO. : 5,924,173

DATED : July 20, 1999

INVENTOR(S) : Dobreski et al.

It is certified that errors appear in the above-identified patent and that said Letters Patent is hereby corrected as shown below:

In claim 4, column 4, line 52, delete "form" and insert --from-- therefor.

In claim 10, column 5, line 30, delete "form" and insert --from-- therefor.

In claim 16, column 6, line 31, delete "form" and insert --from-- therefor.

Signed and Sealed this

Thirtieth Day of May, 2000

*Attest:*

Q. TODD DICKINSON

*Attesting Officer*

*Director of Patents and Trademarks*